US005110287A

United States Patent [19]

MacPherson et al.

[11] Patent Number: 5,110,287

[45] Date of Patent: May 5, 1992

[54] INFRA-RED BURNER SYSTEM FOR FURNACES

[75] Inventors: Collin B. P. MacPherson, Morpeth; Graham N. Jefferson, Edgeworth, both of Australia

[73] Assignee: Alcan International Limited, Montreal, Canada

[21] Appl. No.: 698,376

[22] Filed: May 9, 1991

Related U.S. Application Data

[60] Division of Ser. No. 413,831, Sep. 28, 1989, abandoned, which is a continuation-in-part of Ser. No. 163,271, Mar. 2, 1988, abandoned.

[30] Foreign Application Priority Data

Mar. 3, 1987 [AU] Australia ..... PI 0645

[51] Int. Cl.[5] ..... F27D 7/00

[52] U.S. Cl. ..... 432/24; 432/31; 432/18; 431/79

[58] Field of Search ..... 432/24, 31, 18; 431/79

[56] References Cited

U.S. PATENT DOCUMENTS

| | | | |
|---|---|---|---|
| 2,963,353 | 12/1960 | Eastman | 48/196 |
| 3,486,835 | 12/1969 | Grobe | 431/79 |
| 3,990,835 | 11/1976 | Burton, III | 431/79 |
| 4,354,828 | 10/1982 | Benton et al. | 432/24 |
| 4,547,145 | 10/1985 | Jahnke | 431/79 |

*Primary Examiner*—Henry C. Yuen
*Attorney, Agent, or Firm*—Cooper & Dunham

[57] ABSTRACT

A gas burner assembly for a baking furnace is described. It includes a burner tube having an open outer end and an open inner end, with the inner end being arranged to extend through an opening in a furnace wall. A connector is provided for connecting the burner tube to a fuel supply and an infra-red pyrometer is mounted at the outer end of the tube. The pyrometer is axially aligned with the burner tube such that in use the pyrometer is sighted axially through the burner tube and onto an internal furnace wall. This gas burner assembly is particularly useful for heating the flue of a ring furnace used in the production of carbon anodes in the aluminum industry.

5 Claims, 2 Drawing Sheets

INFRA-RED BURNER SYSTEM FOR FURNACES

This is a division of application Ser. No. 413,831, filed Sep. 28, 1989, now abandoned, which is a continuation-in-part of application Ser. No. 163,271, filed Mar. 2, 1988, now abandoned.

BACKGROUND OF THE INVENTION

1. Field of the Invention

This invention relates to a gas burner for a furnace, and more particularly, to a gas burner incorporating a temperature sensing means for the automatic control of a baking furnace.

2. Description of the Prior Art

The present invention has particular application to the production of carbon anodes for use in producing aluminum, e.g. for automatically controlling the baking temperature of raw anodes within close tolerances to produce uniformly baked anodes. The production of such carbon anodes has for many years been done in a so-called ring type baking furnace. Such furnaces consist of a honeycomb of rectangular refractory pits in which the carbons are baked, heat being applied to the carbons for preheating and baking, and removed after cooling, by suitable gas flow through flues in the walls of the pits. The pits are arranged in small groups known as sections, and these sections are arranged as a complete system in the form of a ring. The flues are usually built in the longitudinal walls of each pit and are arranged for communication with the flues of adjoining pits.

During operation, several pits in each row are subjected to preheating of green or unbaked bodies, several pits receive highest baking heat and several pits undergo cooling, all based upon the condition of the gas flowing in the sequence of flues along the pits. Thus gas, preferably cold air, enters the flue system adjacent the last of the pits under cooling, passes the series of pits under preheating and then the region of the final baking pits where the highest temperature heat, e.g. fire from burners, is injected into the gas stream.

For continuing operation, the circumstances of the flue portions adjacent the pits are altered intermittently, e.g. each 18 to 64 hours, with the locality of the fire injection being advanced concurrently with the direction of gas flow, whereby at each change a filled but unheated pit is added to and a pit with finished carbon bodies is removed from the sequence of pits under treatment. In this way each filled pit is subjected to the entire series of steps over a total period of many days.

In a typical commercial operation, the pits are arranged in sections of several pits each and many sections are disposed for lengthwise alignment of the pits, with the complete structure providing in effect several rows of many endwise successive pits, each with heat exchange gas flues between the rows and along the outside rows. A plurality of temporary baking units can be arranged at any one time in each row and conveniently the fire burner means is arranged as manifolds or burner bridges crossing the array of rows and movable to successive positions along the array. A number of such manifolds may be provided whereby a number of successive baking units can be set up in each row, and parallel such units in several units can simultaneously be advanced, section by section. Such a system is described in considerable detail in Holdner, U.S. Pat. No. 4,253,823 issued Mar. 23, 1981.

The rate of temperature change used to reach the finishing temperature on each baking cycle, as well as the temperature distribution in each flue, has traditionally been controlled by manual observation and adjustment of individual burners. This manual operation has, in the past, produced an adequate though inconsistent quality of carbon anodes. The current emphasis is on improved product quality and economic considerations dictate the need for more sophisticated control systems. By introducing automatic carbon body baked furnace control systems using relevant data collected from sensors within the furnace system, improvements in product quality, lower fuel requirements and longer flue life can be achieved.

One such bake furnace control system is described in Benton et al U.S. Pat. 4,354,828 issued Oct. 19, 1982. That system utilizes infra-red temperature detectors which measure pit or anode temperatures, as well as infra-red temperature detectors for measuring the flue or brick temperature of the flue walls of the furnace. The information received from these sensors is then used to either increase or decrease the amount of air being fed to the burners.

Systems of the above type have concentrated on obtaining information regarding the temperature of the flue gas or bricks in the flues downstream of the fire injection point, and using this information as the control variable. Depending upon how closely each temperature reading correlates with the corresponding predetermined target temperature for certain stages in the baking process, the automatic controller may vary the fuel supply in order to correct any discrepancies. In this type of automatic control, the fuel supply is usually pulsed into the flue at varying rates depending on the difference between the actual flue temperature and the target.

In these prior systems no account was taken of the brick temperature at the fire entry point. Of course, the area of the flue close to the flame zone will reach higher temperatures than areas remote from the flame. The prior temperature monitoring systems do not directly measure the temperatures of such "hot spots" in the furnace flues. Other features of such furnaces, such as baffles in the flues which prevent infra-red radiation propagating very far along the flue wall, and lower heat transfer rates remote from the burner flame, make it difficult to predict upstream temperatures with any accuracy based upon downstream results.

Furthermore, such prior systems have usually employed a rapidly pulsing flame which, depending upon oxygen supply, burns intensely under near ideal combustion conditions and will produce high flame temperatures in the order of 1,500° C. Consequently, problems with local overheating of the flue bricks may occur near the flame and this may not be detected by the downstream temperature sensors.

By the nature of a ring furnace, as mentioned above, it is necessary to move the burner system on a regular basis intermittently approximately each 18 to 64 hours and the burner system must, therefore, be portable. Since the temperature sensors have typically been separate from the burner equipment and since they must also be moved each time the burner system is moved, they represent a further complication to the automatically controlled ring furnace process.

In summary, the present state of the art with respect to automatic ring furnace control systems requires an additional set of equipment which must be moved each time the burner system equipment is moved, and must act on information obtained from sensors that are remote from their critical areas of the furnace, i.e. the combustion areas. This information may have been influenced by many variables within the burner system, such as draught conditions, heat transfer rates, combustion characteristics, etc., and hence the automatic controller is required to predict these variables in order to properly control the furnace conditions.

It is the object of the present invention to overcome or substantially ameliorate the above mentioned problems.

SUMMARY OF THE INVENTION

The present invention in its broadest aspect relates to a gas burner assembly for a furnace comprising a burner tube having an open outer end and an open inner end, with the inner end being adapted to extend through a furnace wall into the interior thereof. Conduit means are provided for connecting the burner tube to a fuel supply. An infra-red pyrometer is mounted at the outer end of the burner tube and in axial alignment with the tube such that in use the pyrometer is sighted axially through the burner tube and onto an internal furnace wall.

The gas burner assembly of the invention also includes a fuel supply flow controller for the burner and a data processer for receiving temperature signals from the pyrometer and adjusting the flow controller. This flow controller is preferably in the form of a pulsing valve.

Rather than using a specialized gas burner such as a flame nozzle, the present invention uses a simple piece of tubing which merely acts as a duct to transport the fuel, preferably natural gas, into the flue thereby producing a long, lazy flame. The gas is supplied into the flue in pulses, each pulse providing an amount of fuel in excess of the locally available oxygen supply. Due to this lack of oxygen, high flame temperatures are not produced and complete combustion of the gas occurs only after it has travelled some distance along the flue. These factors result in a much more even heating along the flue, so that hot spots adjacent to the burner flame are far less likely to occur.

Temperature readings are not taken while the fuel is being combusted, and the fuel flow is interrupted for a short period of time, e.g. about 10 seconds, at regular intervals, e.g. every 4 to 10 minutes, to take brick temperature readings from within the flue without the presence of a flame. The incoming fuel supply preferably comes into contact with, and hence assists in the cooling of the pyrometer thereby eliminating the need for any special water or air cooling systems.

The temperature readings from the infra-red pyrometer are sent to a fully programmable controller of known type where each reading is compared with a preset target value for that stage of the baking process. Any discrepancies between these two values results in a proportional/integral control loop of the controller regulating the fuel supplied to the flue burner via the pulsing valve to counteract the discrepancy. The fuel pulsing is preferably of a low frequency type, providing a compromise between continuous flow and rapid pulsing.

A preferred cycle for the pulse valve is a fix no-flow cycle of about 1 second and a variable flow cycle of about 0–1 second. Of course, it is also possible to operate with both flow and no-flow cycles of fixed duration with a variable gas flow rate during the flow cycle.

An important advantage of the gas burner system of the present invention with an integral infra-red pyrometer is that it eliminates the problem of moving both a burner assembly and the temperature sensor separately and furthermore permits the direct measurement of the flue brick temperature in the combustion zone, thereby providing a more accurate and efficient means for controlling the baking process.

The foregoing and other features of the invention are explained in more detail in the description below, with illustration in the accompanying drawings.

DESCRIPTION OF THE PREFERRED EMBODIMENTS

Figure 1:
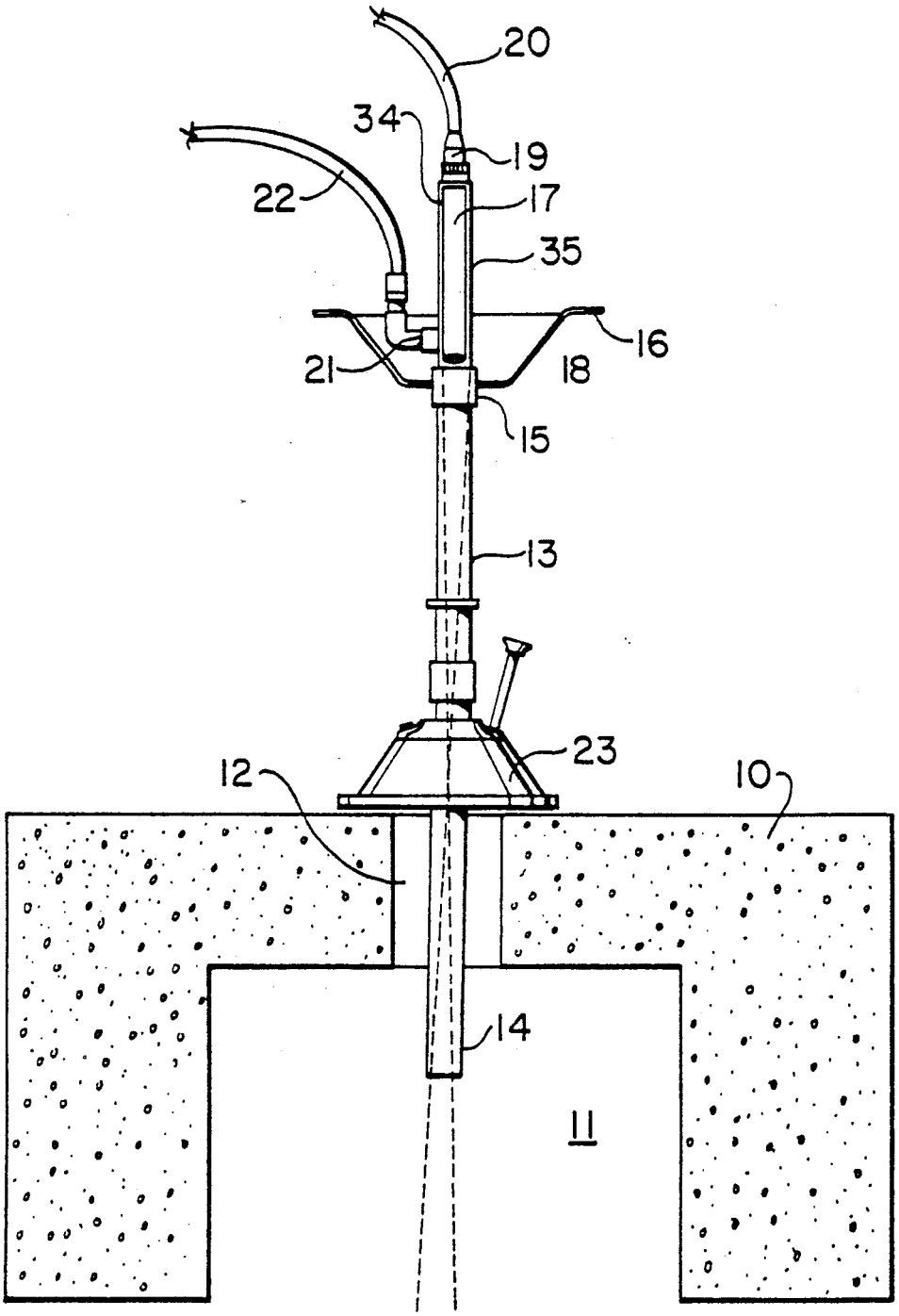
FIG. 1 is a simplified, schematic view of a furnace flue with a burner assembly according to this invention in place.

Referring to the drawings, a furnace wall 10 is shown with a flue 11. A service opening 12 extends from the flue through the furnace wall 10.

Mounted in the service opening 12 is a burner tube 13 in the form of a hollow tube having a nominal bore of about 25 mm. This tube 13 has an inner end portion 14 and an outer end portion 15, with a collar 23 positioned adjacent the furnace wall 10 to cover opening 12. A handle 16 is positioned at the outer portion 15 of tube 13 and above this handle is mounted an infra-red pyrometer 17 within a tubular casing 35. The pyrometer includes an optical lens 18 at the lower end thereof and an annular space 34 is provided between the pyrometer 17 and the tubular case 35 therefor. A connector cable 20 is connected to the upper end of pyrometer 17 via plug 19 and this cable connects to a computer for controlling the system.

A gas supply connector tube 22 is connected to each burner tube 13 via coupling 21 and with this arrangement the gas circulates in the annular space 34 around the pyrometer thereby assisting in the cooling of the pyrometer.

Figure 2:
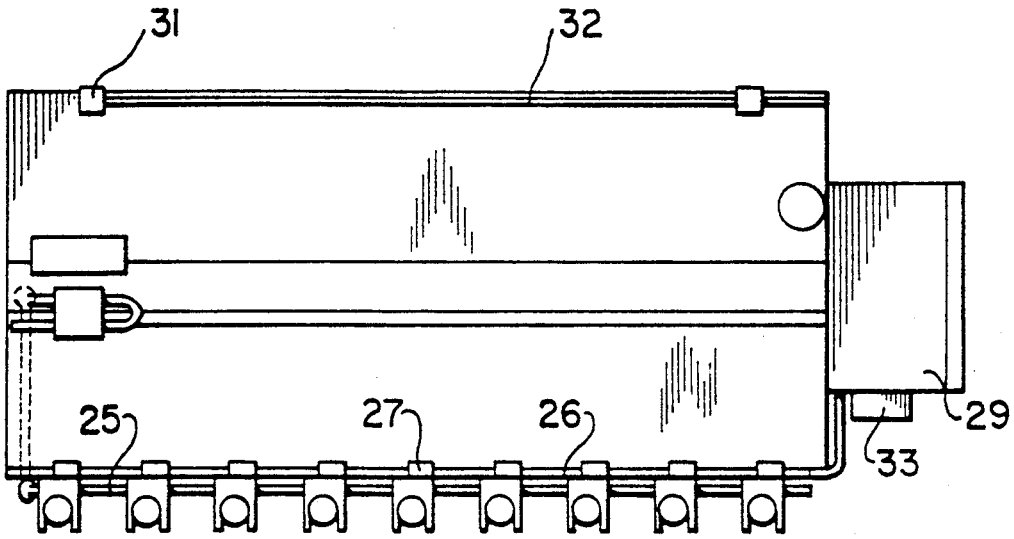
FIG. 2 is a plan view of a burner bridge according to the invention.
Figure 3:
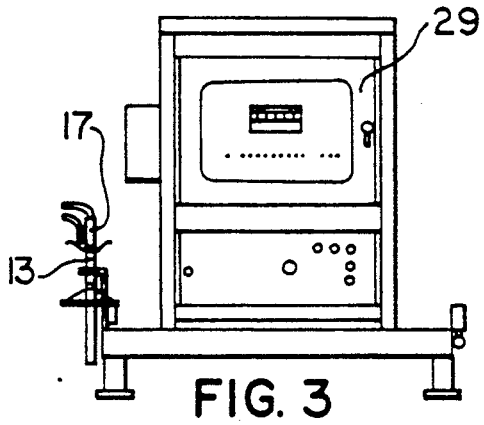
FIG. 3 is a side elevation of the burner bridge of FIG. 2.
Figure 4:
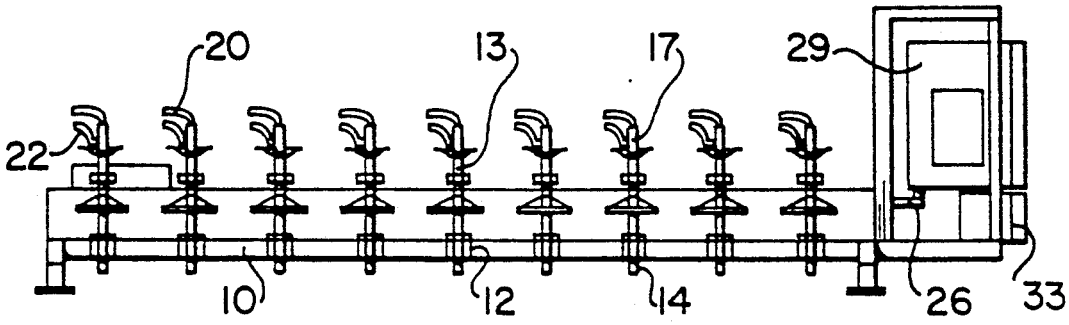
FIG. 4 is an end elevation of the burner bridge of FIG. 2.

A series of burner units are arranged in the form of a portable burner bridge as can best be seen from FIGS. 2, 3 and 4. The gas connector tubes 22 connect to a main gas pipe 25 and the pulsing flow is controlled by pulsing solenoids 27. A connector cable 26 provides control signals to the pulsing solenoids 27 from a microcomputer 29.

Additional thermocouples may be provided in the system, e.g. in sockets 31 and these are connected via electrical conduit 32. These thermocouples may be used to monitor pit temperatures between anodes.

The flue pressure may also be monitored by the system and for this purpose the system includes a flue pressure transmitter control box 33. This can detect possible hazardous situations, usually as a result of blocked flues, and shut down the burners if the draught falls below a critical value.

It is to be understood that the invention is not limited to the specific steps, operations and means herein described and shown, but may be carried out in other ways without departing from its spirit.

We claim:

1. A method for controlling the temperature of a fuel-fired furnace, said furnace having walls with internal refractory linings defining a combustion chamber; a burner tube having an open outer end and an open inner end, said inner end extending through said furnace wall into the combustion chamber; conduit means for connecting the burner tube to a fuel supply; an infra-red pyrometer mounted at the outer end of the burner tube and in axial alignment therewith such that the pyrometer is sighted axially through the burner tube and onto an internal furnace wall opposite the burner; fuel supply control means; and a data processor;

said method comprising feeding fuel through said conduit means into the burner tube and burning the fuel to produce a flame extending into the combustion chamber, periodically stopping the fuel flow to the burner for a time sufficient to eliminate any flame in the combustion chamber, activating the pyrometer when no flame is present and obtaining a signal indicative of the temperature of the refractory lining, feeding said signal to the data processor, comparing the signal with a preset target value and adjusting the fuel supply controller means when a discrepancy occurs between the measured signal and the preset target value.

2. A method according to claim 1 wherein said fuel flow is controlled by a pulsing valve.

3. A method according to claim 2 wherein said pulsing valve is operated with a no-flow cycle of fixed duration and a flow cycle of variable duration responsive to said temperature signals.

4. A method according to claim 3 wherein the no-flow cycle has a duration of about 1 second and the variable flow cycle has a duration of 0–1 second.

5. A method according to claim 1 wherein said data processor stops fuel flow through said control means for at least 10 seconds at regular intervals every 4 to 10 minutes and also receives temperature signals from the pyrometer when fuel flow is stopped.

* * * * *